US005676872A

United States Patent [19]

Garcia-Rodriguez

[11] Patent Number: 5,676,872

[45] Date of Patent: Oct. 14, 1997

[54] FLEXIBLE HEATING ELEMENT HAVING A LAYER OF FIXING VARNISH

[75] Inventor: Manuel Garcia-Rodriguez, Rubi, Spain

[73] Assignee: Bobinajes Nugar, S.L., Rubi, Spain

[21] Appl. No.: 576,076

[22] Filed: Dec. 21, 1995

[30] Foreign Application Priority Data

Dec. 27, 1994 [ES] Spain ..... 9402641

[51] Int. Cl.[6] ..... H05B 3/34; H01C 3/18

[52] U.S. Cl. ..... 219/549; 219/542; 219/528; 219/544; 338/264; 338/301

[58] Field of Search ..... 219/520, 524, 219/526, 542, 534–535, 544, 549, 528, 546, 541; 338/263–264, 301, 304, 322; 432/225; 439/421–422, 426, 435, 442

[56] References Cited

U.S. PATENT DOCUMENTS

| | | | |
|---|---|---|---|
| 2,119,292 | 5/1938 | Rollefson | 29/618 |
| 3,249,983 | 5/1966 | Cobaugh | 439/426 |
| 3,757,086 | 9/1973 | Indoe | 219/528 |
| 3,887,894 | 6/1975 | Rudd et al. | 338/264 |
| 4,185,263 | 1/1980 | Frey | 338/301 |
| 4,272,673 | 6/1981 | Semanaz et al. | 219/544 |
| 5,018,986 | 5/1991 | Freitag | 439/421 |
| 5,137,468 | 8/1992 | Murakami | 439/422 |
| 5,343,018 | 8/1994 | Limbach | 219/535 |
| 5,434,388 | 7/1995 | Kralik et al. | 219/542 |

FOREIGN PATENT DOCUMENTS

| | | |
|---|---|---|
| 0245776 | 5/1987 | European Pat. Off. . |
| 0411542A2 | 7/1990 | European Pat. Off. . |
| 0411542A3 | 7/1990 | European Pat. Off. . |
| WO90/06010 | 5/1990 | WIPO . |

*Primary Examiner*—Teresa J. Walberg
*Assistant Examiner*—Raphael Valencia
*Attorney, Agent, or Firm*—Michael J. Striker

[57] ABSTRACT

A heating element has a flat, flexible strip of electrically insulating material around which is wound a conductor wire. A layer of fixing varnish covers the turns of the conductor wire and the flat strip. Two clips attached to the ends of the strip provide electrical contact with the conductor wire and serve to attach two electricity connection cables. The heating element can be bent without this affecting its ohm value since the fixing varnish prevents the turns of the conductor wire from moving when the strip is being bent.

5 Claims, 3 Drawing Sheets

FLEXIBLE HEATING ELEMENT HAVING A LAYER OF FIXING VARNISH

BACKGROUND OF THE INVENTION

This invention relates to a heating element suitable for application on the rigid surface of objects in order to transfer heat to them by passing an electric current through the heating element.

Such heating elements can be used to heat all kinds of industrial or domestic objects, such as: feeding bottles, fish tanks, car steering wheels, window cleaners, locks, hair rollers, evaporators for air fresheners, insect repellents, balm products etc. In each case the heating element must adopt the outer shape of the body to be heated or, in the case of evaporators, the shape giving the most suitable heat-transfer geometry, e.g. a toric shape surrounding the wick of the evaporator without touching it.

Flexible heating elements have been described previously, in patents EP-411542, WO 90/06010 and EP-245776. None of them ensures that the ohm value of the heating element remains constant during bending, and moreover none is produced by a procedure that is cheap enough to make its application viable in the domestic products mentioned above.

SUMMARY OF THE INVENTION

Accordingly, it is an object of the present invention to provide a flexible heating element which avoids the disadvantages of the prior art.

In keeping with these objects and with others which will become apparent hereinafter, one feature of the present invention resides, briefly stated, in a heating element in which a safe heating element, free from any overheating that might cause spontaneous ignition and even fires. A heating element of this kind is particularly appropriate for domestic applications, and achieving it is one of the objectives of this invention.

Another object of this invention is to achieve a controlled, steady flow of heat, for which the resistance value in ohms must remain constant during bending.

Lastly, arriving at an essentially inexpensive product is sought, one whose value would be only a small fraction of the value of the product it is to heat, in such a way that the resulting device may remain competitive in the market.

When the heating element is formed in accordance with the present invention, it solves the above mentioned problem and attains the objective set consists of a flat strip of electrical insulating material that is heat-resistant and highly flexible, a conductor wire wound continuously around the flat strip with its longitudinal ends connected to a power supply circuit, and a layer of fixing varnish which completely covers the strip and the turns of the conductor wire, all so arranged that the layer of fixing varnish holds down firmly each turn of the conductor wire in position on the strip, preventing it from slipping on the strip during any bending to which the heating element may be subjected and preventing electrical contact between the turns of the conductor wire during any such bending, in such a way that the ohm value of the heater element remains constant in all cases.

According to another characteristic feature of the invention, a metal clip is provided at each end of the strip, pressing mechanically on it and penetrating the layer of varnish to make electrical contact with several end-turns of the conductor wire at the ends of the heating element, and each having a cable connecting them to the electricity supply circuit.

According to another characteristic feature of the invention, each of the metal clips consists of a flat metal plate with its ends folded into a U shape, the central portion being fitted on one face with small protuberances which are designed to be plastically deformed, the clip being arranged in such a way that the two side portions of the U shape fit around one end of the heating element and grip it, while the two protuberances penetrate the layer of varnish and provide electrical contact with the corresponding connection cable.

According to another characteristic feature of the invention, one of these clips is provided with a ring on its central portion, preferably press-formed, into the eye of which one of the connection cables may be inserted, it then being possible to arrange plastic deformation of this ring making it press down on and clamp firmly in place the connection cable in order to ensure mechanical and electrical contact between the cable and the clip.

According to another characteristic feature of the invention, the heating element is contained inside a body provided with a hole in its centre with runs through it, the body consisting of at least one internal piece and one external piece which fit together with some space between them for containing the heating element, in such a way that the latter, when the internal piece is inserted inside the external piece, is hermetically sealed in between the two pieces, which are fixed together by coating them with a sealing material on the outside in order to make up this body, it also being provided with holes for taking the connection cables.

BRIEF DESCRIPTION OF THE DRAWINGS

The drawings attached illustrate, as non-limiting examples, an embodiment of this invention.

DESCRIPTION OF PREFERRED EMBODIMENT OF THE INVENTION

Figure 1:
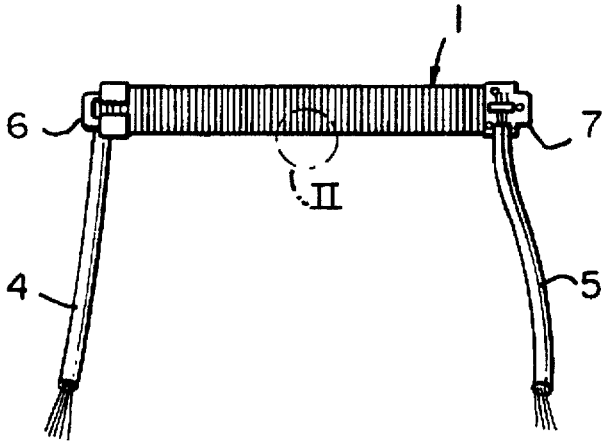
FIG. 1 shows a view of the heating element of this invention in stretched-out form.

As can be seen from the drawings, the heating element (1) consists of a flat, flexible strip (2) of electrically insulating and heat resistant material, upon which is wound, through a continuous turning process, a very fine conductor wire (3).

Figure 2:
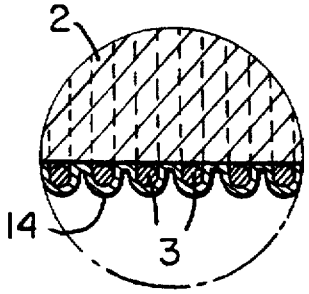
FIG. 2 is a blown-up detail of portion II of FIG. 1.

As can be seen in FIG. 2, the strip (2) wound on the conductor wire (3) has a fine layer of fixing varnish (14)

applied to it. It is applied by immersing the strip with its winding in a bath of liquid varnish. Afterwards, after drying and/or curing the varnish layer (14), it adheres strongly to the strip (2) and to the turns of the conductor wire (3).

After drying and/or curing, this varnish has good heat resistance for the working temperatures of the heating element (1) and is sufficiently flexible for the varnish layer (14) not to have any significant adverse effect on the flexibility of the wound strip (2). The varnish layer adheres to the strip (2) and to the turns of the conductor wire (3) in such a way that the fixing varnish (14) retains the turns (3) in position on the strip (2) during any bending of the strip (2), preventing the wire (3) from moving around on the strip (2). Thus the ohm value of the heating element (1) remains constant throughout any bending of the strip (2).

A power connection cable (4, 5) is fitted to each end of this wound strip (2). These cables (4, 5) make electrical contact with the conductor wire (3) owing to U-shaped clamps (6, 7) which provide electrical and mechanical contact between the wire (3) and the cables (4, 5).

Figure 3:
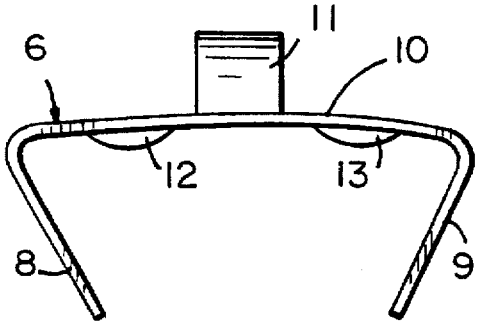
FIG. 3 shows a front elevation of one of the clips providing contact between the heating element and the cable.
Figure 4:
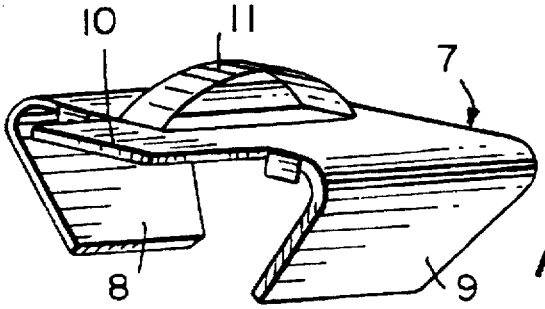
FIG. 4 shows a perspective view of the clip shown in FIG. 3.

Each of these clips has two side portions (8, 9), and a central portion (10) to which the side portions (8, 9) are joined, as can be seen in FIGS. 3 and 4.

The central portion (10) has a ring (11) and two protuberances (12, 13) on the side opposite the ring (11). The end of a connection cable (4, 5) is passed through the eye of the ring (11), and the ring (11) is later plastically deformed until good electrical contact and good mechanical fastening are achieved.

The side portions (8, 9) are turned in towards the side opposite the ring (11), wrapping around the ends of the wound strip (2), until a plastic deformation occurs causing attachment to the strip.

During this procedure, the central portion (10) of the clip (6, 7) presses strongly against one of the faces of the strip (2). As a result of this pressure, the protuberances (12, 13) break the layer of varnish (14) and penetrate through it to make contact with the conductor wire (3). It is thus these protuberances (12, 13) that provide electrical contact between the heating element and the clips.

In this way an element is achieved that can be bent with no change in its ohm value, and that is highly cost-saving.

Hereunder are described, as non-limiting examples, several practical applications of the heating element (1).

Firstly, in very general terms, the heating element (1) can be applied to the surface of an object to which it is wished to transfer heat. Thanks to the flexibility of the heating element (1), it can be made to adhere to the surface of the object with the aid of a glue. When the element is stuck onto the object, a layer of silicone or some other insulating material is applied to cover the wound strip (2) and the clips (6, 7) completely. With this arrangement, applying an electric current to the ends of the connection cable suffice for the heat-transfer process to the selected object to begin.

Figure 5:
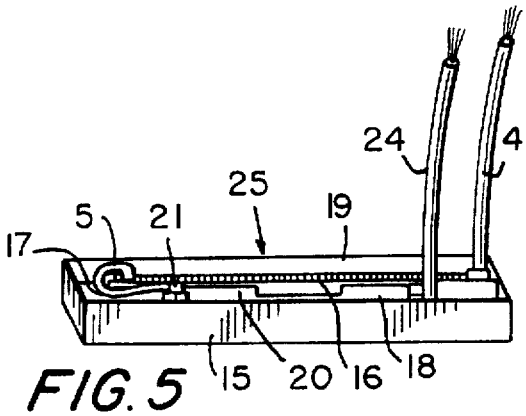
FIGS. 5 and 6 are two diagrams, in perspective, of an application of the heating element of this invention in an encapsulated heating device, in which the capsule is straight-edged, though it could also be curved in design.
Figure 6:
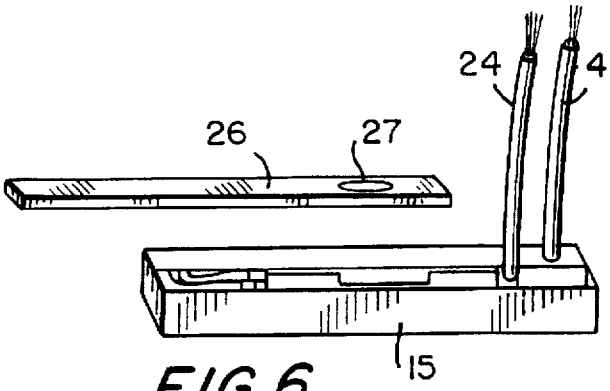

One possible application of the heating element (1) is a heating appliance (20) such as the one shown in FIGS. 5 and 6. Here the heating element (1) is encased in a capsule (15) that is electrically insulated and made of a material that can withstand the working temperatures of the heating element (1). In the example shown in FIG. 5, the capsule is of a generally straight-edged shape, though it could be of any curved, flat or three-dimensional shape, since the flexibility of the heating element (1) enables it to adapt to any curved form, as has previously been noted.

The capsule (15) is in the form of a box that is open on top. A longitudinal divider (16), made of the same material as the rest of the box, divides the interior of the box into two parallel cavities (18, 19). This longitudinal divider (16) has an opening (17) at one end.

The heating element (1) is arranged in one of the cavities (18) of the capsule (15), and it takes the shape (straight in this case) of the capsule's geometry. One of the connecting cables of the heating element (1) goes out of the capsule (15) through its open top.

The other connection cable (5) of the heating element (1) remains inside the capsule (15) and connects cavity (18) with cavity (19) by passing through the opening (17) provided for this purpose.

The cavity (18) that contains the heating element (1) is then filled with a liquid product that is hardenable and sealing, e.g. an epoxy resin.

The connection cable (5) is in cavity (19), and a thermal fuse (20) is connected to it (see FIG. 6) by means of a clip of the same sort as the clips (6, 7) of the heating element (1).

The thermal fuse (20) shown in FIG. 6 is made of a metal alloy. This thermal fuse (20) is initially straight in form, yet it can be plastically deformed to take on shapes analogous to those of the heating element (1), in combination with which it is applied.

It also has two clips (21, 22) similar to the clips (6, 7) of the heating element. Finally, it is fitted with two connection cables (23, 24). The layout of this fuse becomes evident on consulting FIG. 6.

The metal alloy from which the fuse (20) is made and its size are chosen so that this fuse (20) comes into operation when for whatever reason the temperature in the device (25) approaches the temperature at which the hazard of ignition appears. When this occurs the fuse (20) blows and cuts off the power supply, thus cutting out the system. This fuse (20) is a fire-prevention safety device, and enables the heating appliance (25) to be used in domestic applications.

To increase the effectiveness of the fuse, the mid-point of the thermal fuse (20) will be placed in the hottest region of the heating appliance (25), this usually being at the mid section of the heating element (1).

To achieve a good finish for the heating appliance (25), a cover (26) is used, with a small hole (27) for the connection cable (24) to pass through.

Figure 8:
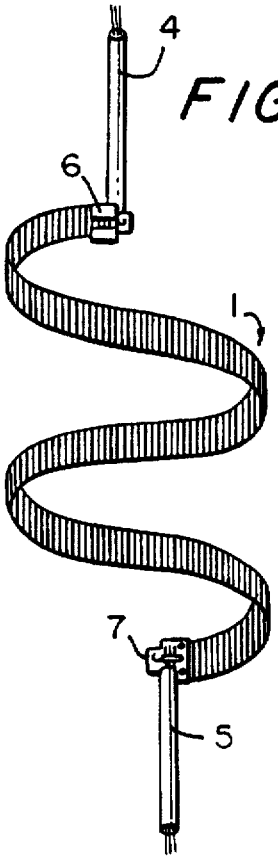
FIGS. 8 and 9 are two perspective views of two embodiments of the heating element of this invention, one arranged in a helicoidal manner and the other in a circular manner.
Figure 9:
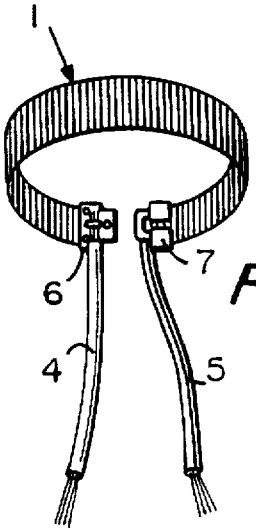
Figure 7:
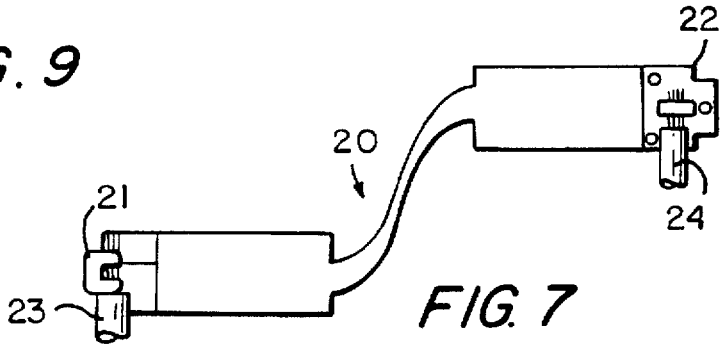
FIG. 7 shows a general view, in perspective, of a thermal fuse which can be used as a safety device in a heating element according to this invention.

Another possible application for the element (1) is to arrange heat transfer to an object with no contact or adherence between the element (1) and the object to be heated—for example, in evaporators for domestic use such as those used for evaporating insecticides, air fresheners or balm products. In these evaporators, the liquid contained in a tray or impregnated in a wick can be evaporated by the heat transferred from the heating element (1). However, this heat transfer is more even and therefore more effective and certain if the heating element (1) is arranged so as to encircle the wick or tray at a set distance. For this purpose the heating element (1) must take on a circular form (FIG. 9) or a helicoidal form (FIG. 8).

Figure 10:
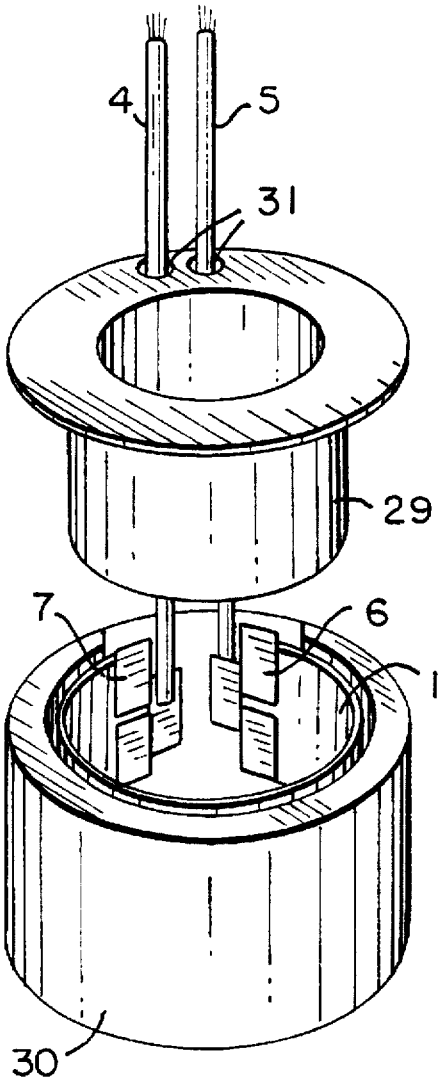
FIG. 10 is a perspective view of the assembly stage of a one-piece body in which the heating element of this invention is contained.
Figure 11:
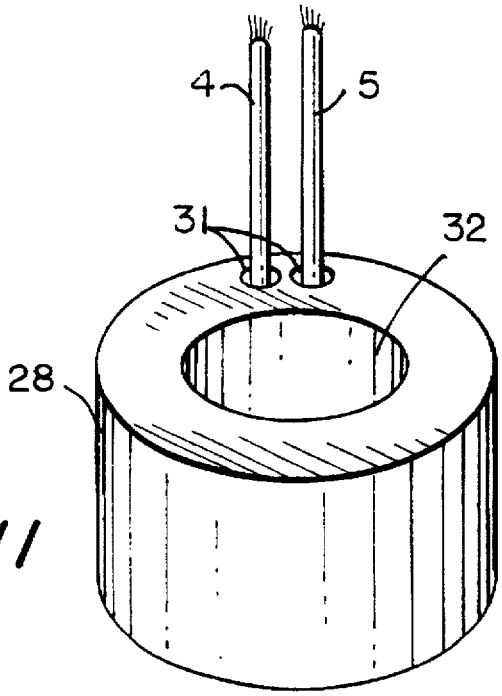
FIG. 11 is a perspective view of the one-piece body of FIG. 10 after assembly.

One application of this circular form is shown in FIGS. 10 and 11. In this embodiment, the heating element (1) is contained inside a body (28), into which the connection cables (4, 5) come through openings (31) provided for them to enter the body (28). The body (28) consists of an inner piece (29) and an outer piece (30), the heating element (1) being coiled in on of them and taking on the circular form shown in FIG. 9. The outer piece (30) fits loosely over the inner piece (29), with the heating element (1) being contained and closed in between them. The two pieces are joined together.

For the object to be heated by the heater element (1) to be encircled by the latter, thus achieving effective heating, the one-piece body (28) has a central opening (32) running through it of a radius size appropriate to the object to be heated.

The nature of the invention having been sufficiently described, as well as the manner of its implementation, it is to be noted that changes of detail may be made to all things provided that the fundamental principle is neither changed nor modified, the essential matter for which a twenty-year patent is sought being summarized in the following claims. It will be understood that each of the elements described above, or two or more together, may also find a useful application in other types of constructions differing from the types described above.

While the invention has been illustrated and described as embodied in a flexible heating element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A heating element, comprising a flat strip of electrical insulating material which is heat-resistant and flexible; a conductor wire having a plurality of turns and wound continuously around said flat strip, said conductor wire having longitudinal ends connectable to a power supply circuit; and a layer of fixing varnish which completely covers said strip and said turns of said conductor wire and arranged so that said layer of fixing varnish holds down firmly each of said turns of said conductor wire in position on said strip so as to prevent each turn from slipping on said strip during any bending to which the heating element may be subjected and preventing electrical contact between said turns of said conductor wire during any such bending, in such a way that an ohm value of the heater element remains constant when the heating element is bent.

2. A heating element as defined in claim 1; and further comprising a body provided with a hole in a center, said body including at least one internal piece and at least one external piece which fit together with some space between said pieces for containing said flat strip with said conductor wire and said layer of fixing varnish so that when said internal piece is inserted inside said external piece, said flat strip with said conductor and said layer are hermetically sealed between said pieces, said body being provided with holes for receiving said cables.

3. A heating element as defined in claim 2; and further comprising means for fixing said pieces with one another by pressure.

4. A heating element, comprising a highly flexible flat strip of electrical insulating material which is heat-resistant and flexible; a conductor wire having a plurality of turns and wound continuously around said flat strip, said conductor wire having longitudinal ends connectable to a power supply circuit; and a layer of fixing varnish which completely covers said strip and said turns of said conductor wire and arranged so that said layer of fixing varnish holds down firmly each of said turns of said conductor wire in position on said strip so as to prevent each turn from slipping on said strip during any bending to which the heating element may be subjected and preventing electrical contact between said turns of said conductor wire during any such bending, in such a way that an ohm value of the heater element remains constant when the heating element is bent, said flat strip having ends; and further comprising a metal clip provided in each of said ends of said strip so as to press mechanically on said strip and penetrate said layer of varnish to make electrical contact with several end turns of said turns of said conductor wire, each of said ends of said strip being provided with a cable for connecting said strip to a current supply circuit, each of said metal clips having a flat metal plate with ends folded into U shape and a central portion with one face provided with small plastically deformable precuberances, each of said clips being arranged in such a way that two side portions of said U shape fit around and grip one end of said strip, while protuberances penetrate said layer of varnish and provide electrical contact with a respective one of said cables.

5. A heating element as defined in claim 4, wherein one of said strips is provided with a ring arranged on said central portion and having an eye in which one of said cables is insertable, said ring being plastically deformable so as to firmly clamp said cable to ensure mechanical and electrical contact between said one cable and said strip.

* * * * *